United States Patent [19]

Kong et al.

[11] 4,004,432

[45] Jan. 25, 1977

[54] HUMIDIFIER KIT FOR ROOM AIR CONDITIONER

[75] Inventors: Carlito Maristela Kong, Dayton; Emerson Lee Wark, Vandalia; Donald Clarence Ferdelman, Dayton, all of Ohio

[73] Assignee: General Motors Corporation, Detroit, Mich.

[22] Filed: Sept. 18, 1975

[21] Appl. No.: 614,745

[52] U.S. Cl. ..... 62/262; 62/314; 98/94 AC; 165/20; 165/21; 261/29; 261/106; 261/110

[51] Int. Cl.[2] ..... F25B 23/12

[58] Field of Search ..... 261/29, 106, 110; 126/113; 62/262, 314 S, 375, 376; 98/94 AC, 30; 165/19, 20, 21, 60; 239/193

[56] References Cited

UNITED STATES PATENTS

| | | | |
|---|---|---|---|
| 3,307,835 | 3/1967 | Perlman | 261/29 |
| 3,570,822 | 3/1971 | Peterson et al. | 261/29 |
| 3,756,311 | 9/1973 | Bitz | 165/21 |
| 3,844,135 | 10/1974 | Zamiara | 62/375 |

*Primary Examiner*—Ronald C. Capossela
*Attorney, Agent, or Firm*—Edward P. Barthel

[57] ABSTRACT

An add-on humidifier kit for use with a room air conditioner includes a cabinet frame extension for mounting on the room-side of the cabinet sleeve. The extension is composed of an upper water distribution header and a lower drain trough retaining a water pad located in an extension of the discharge duct of the air conditioner, while an electrical heating unit is mounted in the extension to heat the return room air to achieve a comfortable temperature, allowing the heated air to pick up moisture from the water pad. A portable water tank assembly is adapted to be positioned on the floor beneath the air conditioner and electrically coupled to the air conditioner through separable connectors providing tank mounted controls for the heating unit along with a humidistat, water flow regulator and water pump mounted in the water tank unit. Controls for the air conditioner electric fan motor are incorporated in the control box of the air conditioner whereby the air conditioner and the humidifier both use the same fan control.

4 Claims, 13 Drawing Figures

HUMIDIFIER KIT FOR ROOM AIR CONDITIONER

This invention relates to air conditioning apparatus and more particularly to a window air conditioning unit having an add-on portable air humidifying kit for cooling and/or humidifying a room or rooms.

The manufacturer of window air conditioners has long shown a need by sales demands to provide a room air conditioner with a humidifying apparatus incorporated in one room air conditioner. It has also been found desirable from a marketing standpont that after a customer has purchased a window air conditioner many purchasers desire to convert the unit to combined summer cooling and winter humidifying. It is an object of this invention to satisfy both of the above desires by means of an add-on humidifying kit with a portable reservoir that may be removed for repairing or replacement without rendering the room air conditioner inoperative.

It is another object of the invention to provide an improved window mounted room air conditioning unit having an extension frame on the room-side of the unit with the extension frame composed of an add-on humidifying unit located in an extension of the cooling air discharge duct, together with heating means mounted below the humidifier unit to warm the incoming room air to a level that is comfortable when discharged through the humidifying unit; and a portable water tank unit separate from the air conditioner and electrically coupled thereto by separable connectors providing tank mounted controls for the humidistat, heater, water flow regulator and water pump while the controls for the blower fan electric motor, which is energized during the humidifying only cycle, remains in the air conditioner control box.

Further objects and advantages of the present invention will be apparent from the following description, reference being had to the accompanying drawings, wherein a preferred form of the present invention is clearly shown.

Figure 1:
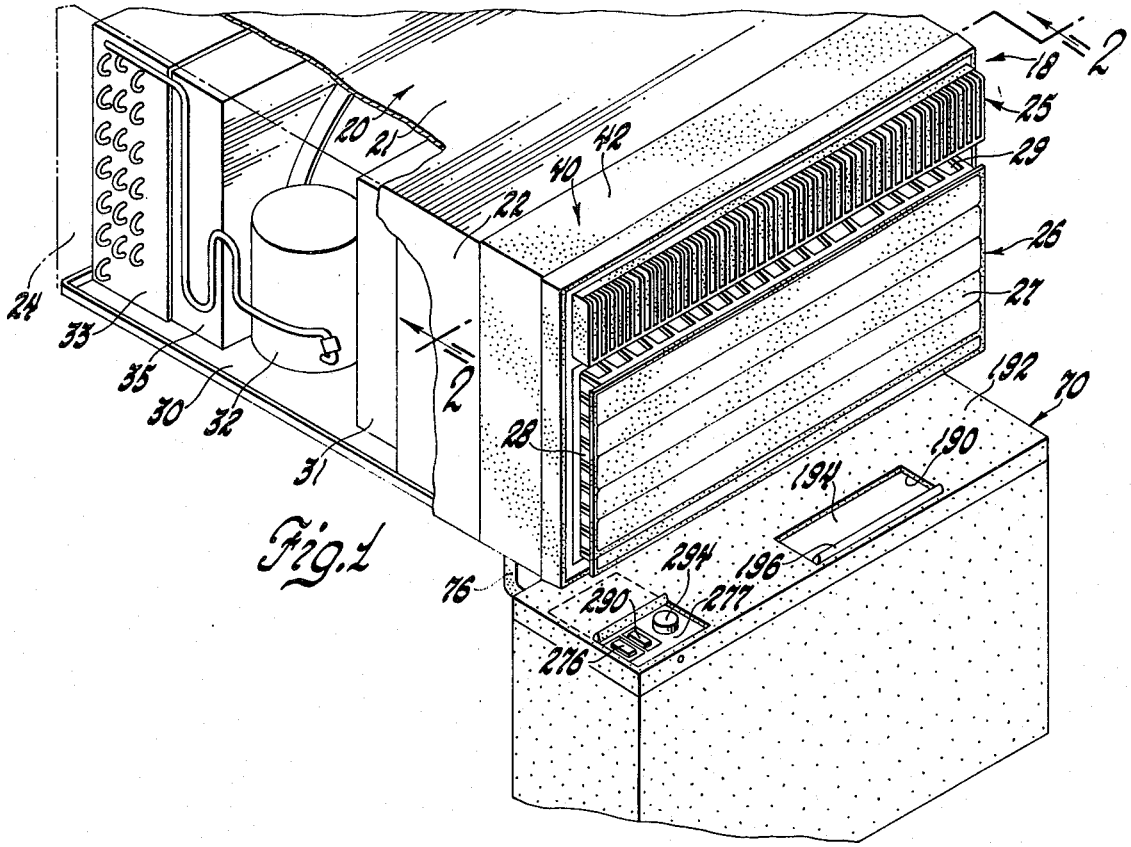
FIG. 1 is a fragmentary perspective view of the apparatus showing the front portion of the room air conditioner unit and the upper portion of the humidifier tank assembly.

Referring now to FIG. 1, there is shown a conventional self-contained room air conditioner 18 including an outer casing or cabinet 20 formed of suitable material such as sheet metal providing a top wall 21, side walls 22 and 23, an outside or rear wall 24 and a removable room-side front assembly divided into an upper or top air discharge grille portion 25 and a lower portion 26. The lowr portion includes a decorative horizontally slidable imperforate front panel or baffle plate 27, spaced in front of the casing front face to permit the required air flow into the casing via a plurality of vertically spaced side openings 28 and horizontally spaced top openings 29. The embodiment of the invention described below is adapted for use with room air conditioner unit 18, as shown in U.S. Pat. No. 3,592,123 to Henken, et al, although it is to be understood that the invention finds like applicability in other forms of air conditioning units.

Figure 3:
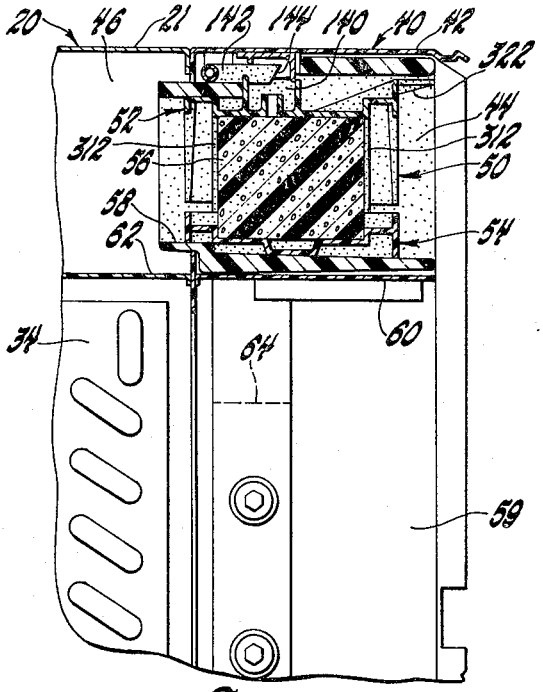
FIG. 3 is a partial vertical sectional view through the air discharge duct of the air conditioner unit.

As best seen in FIG. 1, the air conditioner casing includes a base pan 30 on which is supported an air conditioner chassis or refrigeration system including a sealed motor-compressor 32, a condenser 33 and an evaporator shown at 34 in FIG. 3. A partition and condenser fan scroll assembly 35 including a condenser radial blower fan 36 (FIG. 13) is supported on the base pan 30 along with evaporator fan scroll assembly 31. The details of such an evaporator scroll are shown in U.S. Pat. No. 3,305,162 issued Feb. 21, 1967 to W. B. Hall, Jr., the disclosure of which is incorporated by reference herein. The air conditioning unit, to which the novel humidifier adaptor kit is applied, employs a draw-through condenser fan-cooling assembly in which the condenser scroll 35 surrounds a condenser fan 37 driven by fan motor 38 (FIG. 13), as shown for example in U.S. Pat. No. 3,792,593, issued Feb. 19, 1974, to J. H. Loos et al, the disclosure being incorporated by reference herein.

Figure 2:
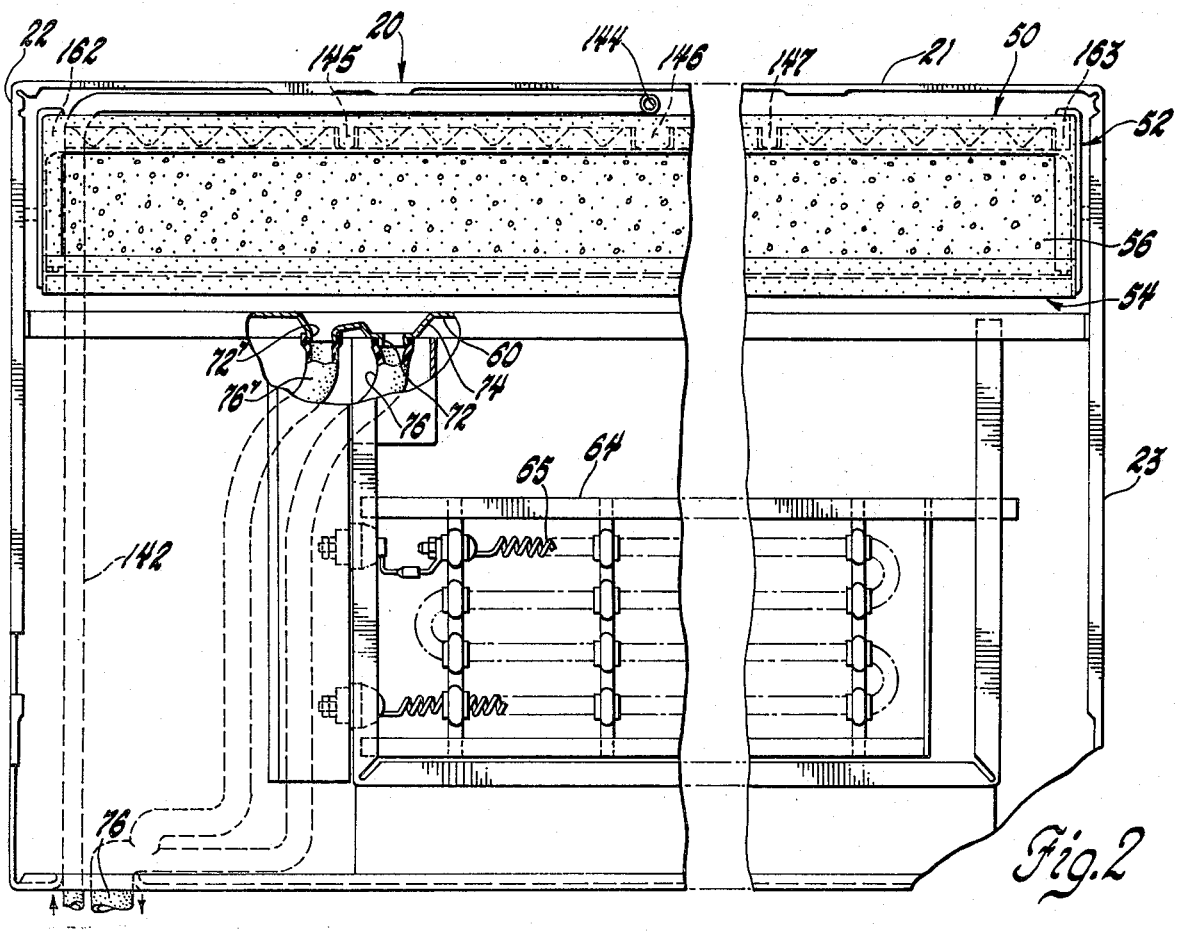
FIG. 2 is a vertical sectional view taken along the lines 2—2 of FIG. 1 with extension omitted for clarity.

As indicated above, the invention comprehends the provision of means for humidifying the air circulated through the air conditioner. Herein the air humidifying means comprises an adaptor kit or humidifier accessory including an extension attachment, generally designated 40, adapted to be installed on the room-side face of casing 20. In the illustrated embodiment, the extension 40 comprises a generally rectangular frame 42 defining an internal upper space 44 (FIG. 3) communicating rearwardly with the front conditioned air discharge duct or air outlet 46 of casing 20. As shown in FIGS. 2 and 3, the upper space 44 receives air humidifying means 50 including an upper header and distribution pan member 52 and a lower drain trough 54 supporting the member 52 which retains a rectangular sectioned water evaporation pad 56 mounted in sealed relation thereto with the pad 56 preferably formed of a water absorbent material such as foam rubber or foam plastic that is pervious to the discharge air flow.

The humidifying means 50, supported on a horizontally disposed partition drain shelf 60, includes a discharge air duct extension 58 communicating with air outlet 46. The shelf 60 divides the frame 42 into the upper space or chamber 44 and a lower space or chamber 59 in which is supported an electric heater assembly 64. A corresponding horizontal partition 62 is mounted in the casing 20 and overlies the evaporation 34 for directing incoming return room air through filter means (see the mentioned Hall patent), heating means in the form of an electric heater assembly 64 and evaporator 34 to the blower 36, and from the blower through the conditioned air outlet duct 46 and the humidifier extension 58. It will be understood that applicants' humidifying means 50 is intended mainly for wintertime humidification and, as shown by the electrical control circuit of FIG. 13, the room air conditioner cooling system is rendered inoperative so that only fan motor 38 operates when a "humidifying only" cycle is selected. It will be appreciated, however, that the discharged humidified air will be cooled by virtue of the evaporating water effect of the humidifying means. Thus, the function of the heater 64 is to insure that the temperature of the humidified air discharged into a heated room is at the proper comfort level by compensating for the evaporation effect. It should be noted that the circuit provides for two levels of heat to be supplied from heater 64, which in the disclosed form delivers about 300 watts for its "low" setting and 600 watts for its "high" setting.

Figure 6:
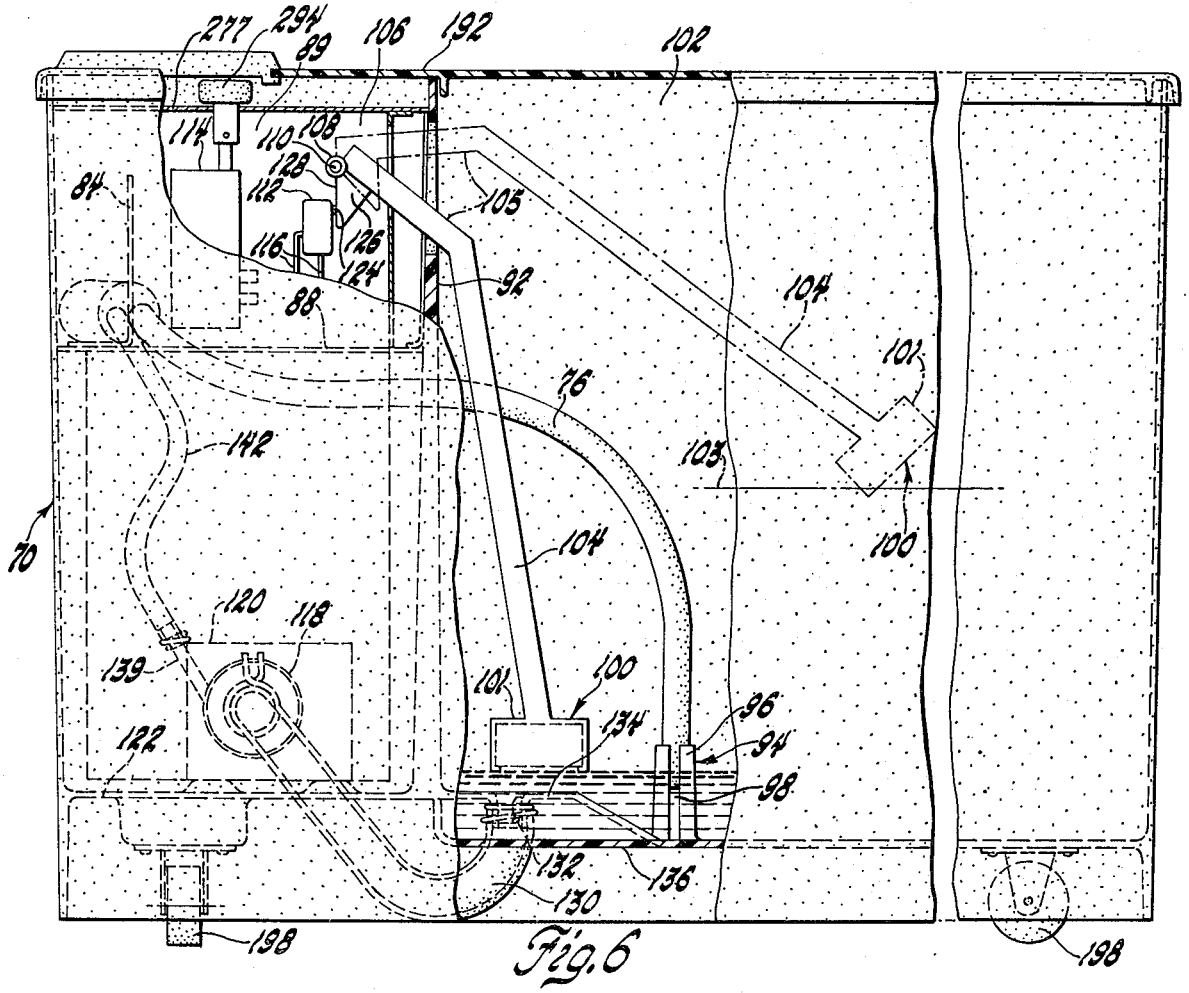
FIG. 6 is a front elevational view of the tank unit, with parts broken away, showing details of the float control arrangement.
Figure 7:
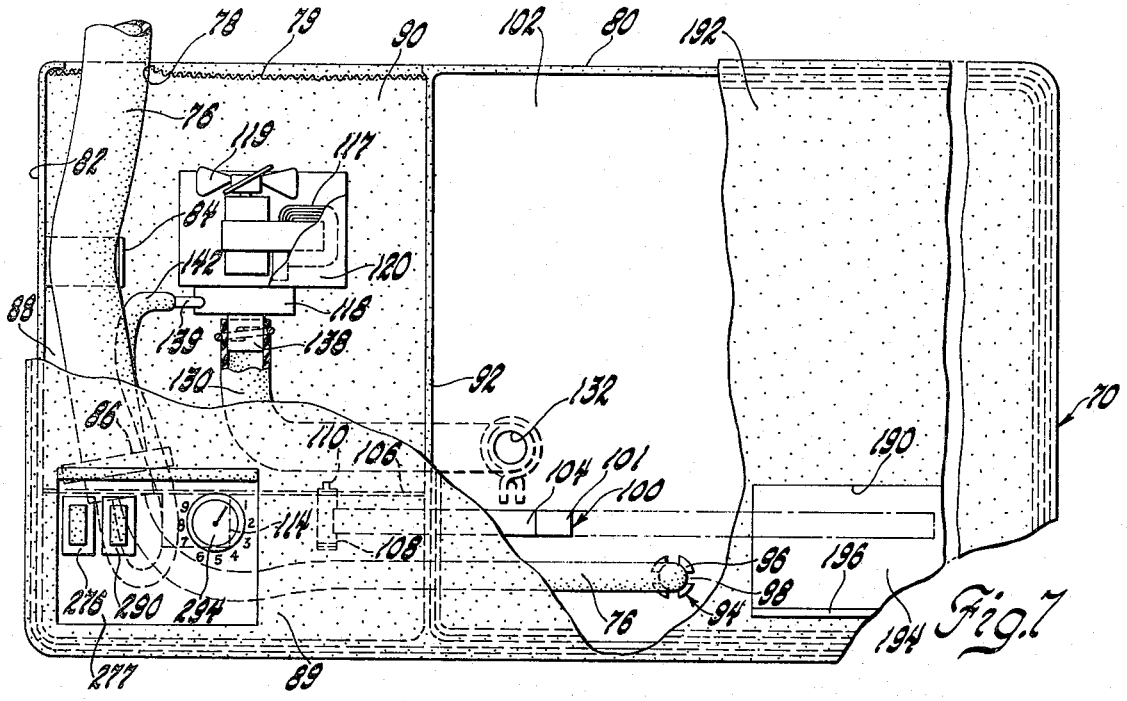
FIG. 7 is a top plan view, with parts broken away, of the humidifier tank assembly.

As best seen in FIGS. 1, 6 and 7, the humidifier kit assembly includes a separate floor tank unit, indicated generally at 70, is adapted to be supported upon the floor of the enclosure to be air conditioned, beneath the attachment extension 40, adjacent the enclosure side wall thereof and/or under the window or wall opening (not shown). In the present invention the shelf 60 has a water return outlet or drain hole 72 indented therein by means of downwardly flared embossment 74. The drain connection comprises a resilient tubular member or conduit 76 that is adapted to receive the embossment 74 of the drain hole 72 to provide a watertight seal. The drain shelf 60 is connected by the conduit or tube 76 to the reservoir unit 70 by virtue of conduit 76 passing through an aperture 78 in screened portion 79 of the tank rear wall 80 (FIG. 7). The conduit 76, supported from the side wall 82 of the floor unit 70 by C-shaped bracket 84, extends through holder 86 supported on partition panel 88 separating upper humidistat control housing 89 from lower pump compartment 90. As seen in FIG. 6, the drain conduit 76 passes through an opening in reservoir tank side wall 92 for telescopic engagement with conduit retention means in the form of a cylindrical or barrel shaped retainer 94 comprising uniformly spaced, upwardly projecting fingers 96 defining a plurality of annular spaced inlet openings 98. In the preferred form there are four fingers 96 spaced at 90° intervals providing four inlet openings 98.

The reservoir portion of the add-on humidifier floor unit 70 is equipped with a float assembly, generally indicated at 100, including a box-shaped float 101 operating in the water receptacle or reservoir 102 to maintain the water level 103 at a desired depth. As viewed in FIGS. 6 and 7, a dog-leg shaped float arm having a lower leg portion 104 and an upper leg portion 105 is pivotally mounted on vertical partition wall 106 by arm cylindrical bushing 108 receiving a pivot pin 110 therein. A switch means in the form of a single-pole single-throw limit switch 112 is mounted on the partition 106 of humidistat control housing 114 and is provided with suitable electrical leads 116 for connection to electric motor 117 driving impeller pump 118 and motor cooling fan 119, located within motor housing 120 supported on base wall 122 of compartment 90. As shown in FIG. 6, the switch 112 includes an actuator 124 which effectively defines a follower cooperating with the edge of cam 126 for automatic control of the switch. The cam 126, carried on the upper leg 105, is provided with an edge surface 128 aligned with the switch actuator 124 such that the cam surface 128 is brought into contact with the actuator 124 to depress same upon the downward pivoting of the float assembly 100 thereby permitting the contacts of switch 112 to open and stop operation of the pump 118.

Water to be used for humidifying the air processed by the room air conditioner is thus stored in the tank 102 at a normal level that is sufficiently high to supply water to the inlet of pump 118 via flexible inlet line or hose 130 connected to tank outlet drain opening 132 formed in the upwardly raised or stepped portion 134 of the tank bottom wall 136. The water is transmitted from pump intake 138 through the pump impeller and exits by radial outlet passage 139 which communicates with the inlet manifold 140 (FIG. 3) and the top of the air humidifying assembly 50 through the long length of flexible hose 142 supported in a second smaller aperture in holder 86.

As seen in FIG. 2, the outlet 144 of the water supply hose 142 is located above the central portion of the water distribution pan or receptacle 52 such that the incoming water is fed or introduced at flow space 146, centered approximately on the transverse center line of the pan. As viewed in FIG. 8, it will be seen that the distribution pan 52 is formed with four longitudinally aligned slot-like openings **148*a*, 148*b*, 148*c* and 148*d* in base 149 each defined by paired parallel dikes or walls. The paired dikes for slots 148*a* are indicated by members 150 and 151 with the walls for slots 148*b* shown at 152 and 153, the walls for slot 148*c* shown at 154 and 155, and the walls for the remaining slot 148*d* are shown at 156 and 157**.

Figure 11:
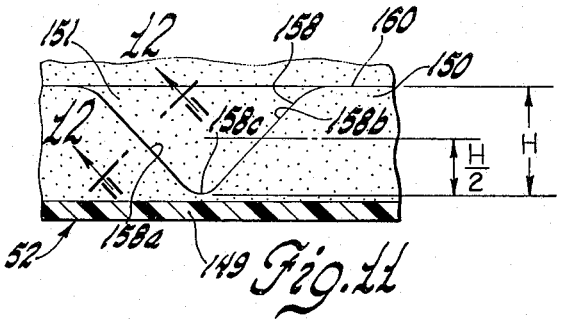
FIG. 11 is an enlarged front elevational view of one of the weirs of FIG. 9.
Figure 12:
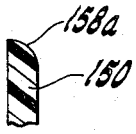
FIG. 12 is a fragmentary sectional view taken on line 12—12 of FIG. 11.

Each of the dikes 150–157 are formed with a plurality of equally spaced identical modified V-notch or triangular weirs one of which is shown generally at 158 in FIG. 11. It will be noted that applicants' typical weir 158 is uniquely different from a conventional V-notch weir firstly in that its 90° converging edges **158*a* and 158*b* terminate in a junction that is rounded or radiused at 158*c* as contrasted with a sharp right angle used for a conventional V-notch weir. In the disclosed form the radius 158*c* is of the order of 0.06 inches. The purpose of applicants' radiused or modified V-notch weir design is to increase the surface tension of the weir 158 thereby allowing the head of the weir to achieve a height of about one-half H before discharging, where H is maximum weir height measured from the upper edge 160 thereof. As seen in FIG. 12 the edges or crests 158*a*, 158*b* and 158*c* of the weir 158 are rounded or curved, which in the form shown has a 0.06 inch radius for high impact polystyrene material 0.06 inch thick, as contrasted with a sharp crested weir to also increase the surface tension of the weir in conjunction with the semicircular portion 158*c*** to allow the head to reach about one-half H before discharge while also providing smooth flow for the weir.

Figure 8:
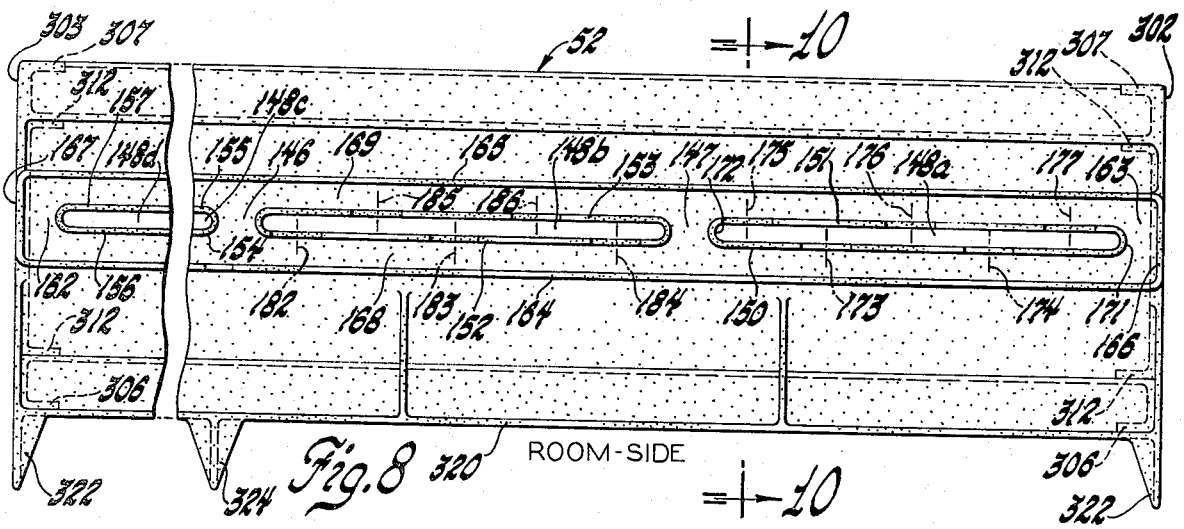
FIG. 8 is an enlarged top plan detail view of the humidifier water distribution system.
Figure 10:
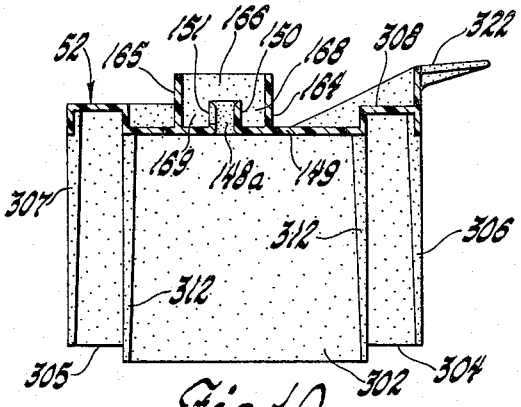
FIG. 10 is an enlarged cross-sectional view of the frame and header taken on lne 10—10 of FIG. 8.

As seen in FIGS. 8 and 10 the four elongated slotted openings **148*a*–148*d* are enclosed by an outer water distributing receptacle formed by side walls 164 and 165 and end walls 166 and 167, which preferably have a height of about twice the height of the walls 150–157. Thus, in the disclosed form the receptacle walls 164 and 165 are about 0.70 inches while the walls 150–157 are about 0.38 inches. The distributing receptacle provides two parallel fore and aft water channels 168** and 169 interconnected by intermediate cross channels 145, 146 and 147 and end cross channels 162 and 163. The center cross channel 146 is formed wider to accommodate the inlet water flow from hose outlet 144 allowing water to pass into both longitudinal header or distribution channels 168 and 169 and flow in either outboard direction. Because of applicants' novel weir design described above, the water is substantially evenly distributed in the channels and accumulates to a depth of about one-half H, as shown in FIG. 11, before discharging from all the weirs to uniformly moisten the plastic foam evaporation pad 56. It will be noted that the paired walls 150–151, 152–153, 154–155 and 156–157 are joined at their ends by semi-circular portions, as shown at 171 and 172 for elongated slot 158*a* to assist in the smooth flow throughout the distribution channels 168 and 169.

With reference to FIG. 8 it will be seen that the weir arrangement for outboard slots 148*a* and 148*d* is identical whereas the weir arrangement for the inboard slots 148*b* and 148*c* is also identical. Thus, for example the outboard slots 148*a* and 148*d* have two weirs formed in their respective front walls 150 and 156, as shown by weir center lines 173 and 174 for slot 148*a*, while the aft wall 151 has three weirs located in a staggered fashion therebetween on centerlines 175, 176 and 177. The weir arrangement for the inboard slotted openings 148*b* and 148*c* are the reverse, i.e. three weirs in the front walls and two in the aft walls. Thus, as shown by the weir centerlines for opening 148*b*, there are centerlines 182, 183 and 184 for three weirs shown in front wall 152 while rear or aft wall 153 has centerlines 185 and 186 for two weirs shown in rear wall 153.

As viewed in FIG. 1, the means for supplying liquid to the reservoir 102 of floor tank assembly 70 is provided by the reservoir fill inlet 190 located in the top wall 192. Closure means, in the form of a sliding panel 194 operated by handle 196, is provided to maintain the inlet in a closed condition except during the filling operation. The floor tank 70 is supported on castors or wheels, two of which are shown at 198 in FIG. 6, to allow the tank to be easily transported to a source of water wherein the reservoir 102 may be readily filled from a household supply by means of a flexible tube or the like. It will be noted in FIG. 2 that a second overflow or drain hold 72′ may be provided in shelf 60 having a second conduit 76′ which is shown connected to first drain conduit in FIG. 2 to accommodate additional drain water resulting from the use of a constant volume pump 118 together with the variable vertical height differential between the humidifier drain pan 60 and the floor tank 70.

Figure 13:
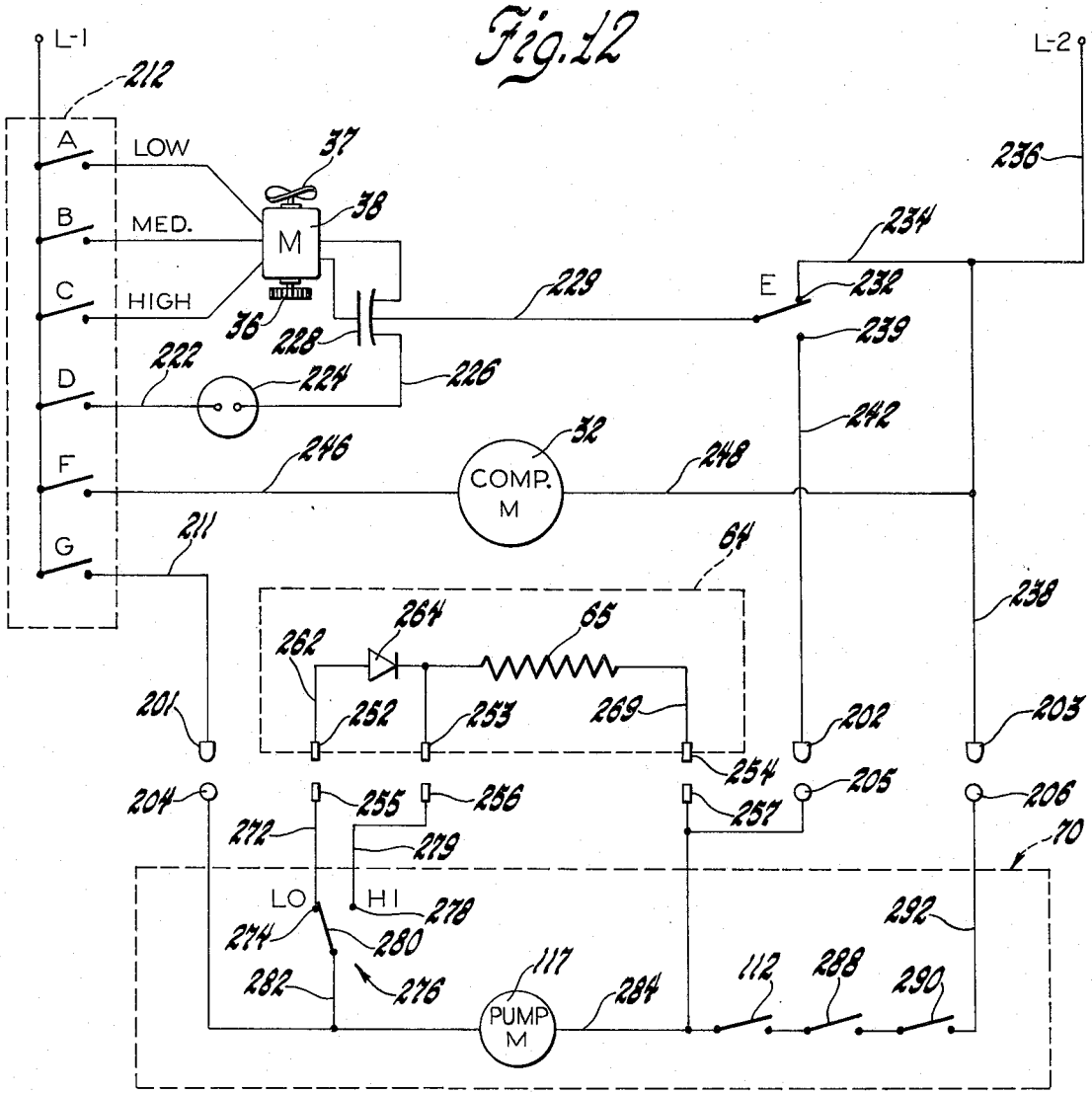
FIG. 13 is a schematic wiring diagram for use with the invention.

Turning now to the electrical schematic of FIG. 13, a suitable source of electric power, represented by lines L-1 and L-2 is connected to first three-prong plug (not shown) having three terminals 201, 202 and 203. The plug is adapted to connect to the terminals 204, 205 and 206, respectively, of a three receptacle socket (not shown) located in the control housing 89 of the tank unit 70. The left terminal 201 connects through conductor 211 to a rotary selector switch, generally indicated at 212, for energizing the motor 38 of the air conditioner fans 36 and 37 illustrated diagrammatically in FIG. 13. The rotary selector switch has three alternately opening and closing switch blades A, B and C for running the fans at low, medium and high speeds, respectively. The switch blade D of the rotary switch 212 connects through conductor 222 to an electronic filter receptacle 224 and thence via line 226 to a fan motor capacitor 228. Line 229 is also attached to the capacitor and connects the fan motor 28 and electronic filter to a single pole-double throw switch blade E, also included within the rotary selector switch 212. The movable contact blade E is shown contacting fixed contact 232 and thence via line 234 and conductor 236 to the L-2 side of the power source while the line 238 connects to the plug right terminal 203. Fixed contact 239 of switch E connects to the terminal 202 via line 242. The movable blade switch E when in its solid line position in contact with fixed contact 232 will cause the fan motor to run continuously while upon blade E being moved to its contact 239 the fan motor 38 and electronic filter receptacle will cycle with the humidifier unit. The switch blade F of the rotary switch 212 is connected via its fixed contact to the motor of the compressor motor unit 32 by line 246 while the other side of the compressor is connected by line 248 to the line 236 and thence to the L-2 side of the power source.

A second three terminal plug (not shown) has three terminal posts 252, 253 and 254 which are plugged into receptacles (not shown) having three mating terminals 255, 256 and 257 respectively. The terminal 252 is connected by line 262 to the cathode of a diode rectifier 264 which has its anode in turn connected to a lead of the electrical resistance heater coil 65 of heater assembly 64 with the other side of the heater coil connected via line 269 to the plug terminal 254. This heater circuit for a room air conditioner is disclosed in U.S. Pat. No. 2,666,002 issued May 30, 1972 to D. C. Ferdelman and assigned to the same assignee as the instant application.

The receptacle terminal 255 is connected via line 272 to a "Low Heat" terminal 274 of a single-pole double-throw heat switch 276 located in the control panel 277 of the floor tank unit 70. The heat switch 276 other fixed terminal 278 provides a "High Heat" position connected via line 279 to the terminal 256. The heat switch 276 has its movable contact 280 connected by means of a conductor 282 to the motor 117 of the humidifier impeller pump which in turn is connected by line 284 to the movable contact of limit switch 112, controlling a suitable water level indicator means (not shown) which deenergizes the unit if the reservoir is emptied of water. The limit switch 112 is in series with switch 288 of a humidistat 114 and an "On-Off" switch 290 the fixed contact of which is connected by line 292 to the terminal 206 of the first power plug receptacle. The humidistat 114 has a control knob or controller 294 which allows the operator to adjust the himidity level of the room being conditioned.

Figure 9:
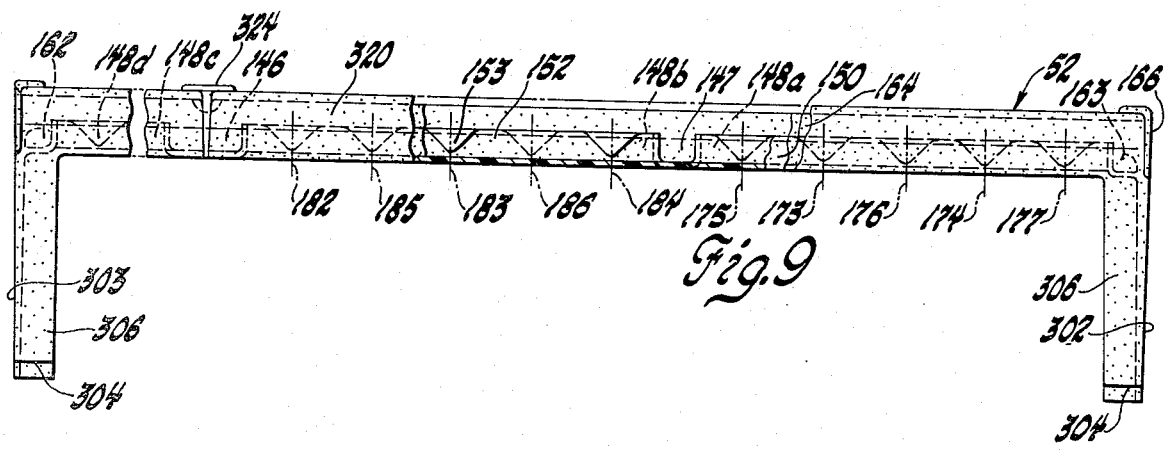
FIG. 9 is an enlarged front elevational view of the frame and header portion of the humidifier.

As viewed in FIGS. 2, 3, 9 and 10, it will be seen that the humidifier frame and header of FIG. 9 has end face panels 302 and 303 formed with notched portions as shown by front and rear notches 304 and 305 of panel 302 in FIG. 10. The notched portions together with right-angled front corner flanges 306 and rear corner flanges 307 are dimensioned to engage the stepped upper surface portion 308 of the dstribution pan 52. It will be noted that the end panels 302 and 303 also include vertical inner ribs 312 dimensioned to slidably retain the ends of the evaporation pad 56.

The front wall 320 of the humidifier frame and header includes a plurality of end spacer members 322 and intermediate space members 324 which act to engage the front assembly 25 so as to axially position the humidifier 50 air outlet a predetermined distance from the front assembly when the components are assembled in their operative position.

Figure 4:
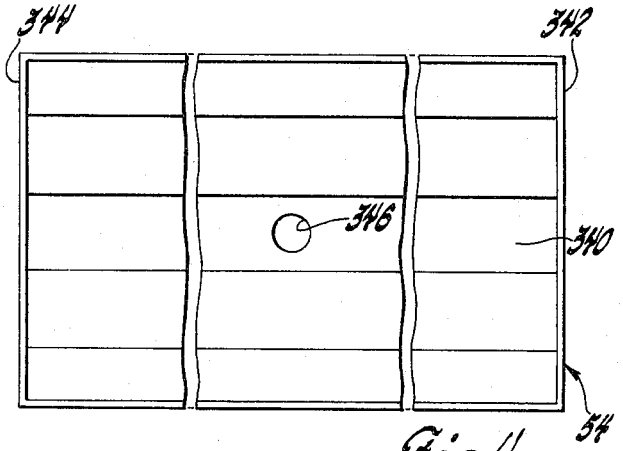
FIG. 4 is an enlarged horizontal plan view of the drain trough.
Figure 5:
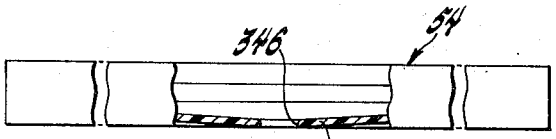
FIG. 5 is a front elevational view of the drain trough with portions broken away.

As shown in FIGS. 4 and 5 the lower drain trough member 54 includes a central drain channel 340 having its base transversely sloped from each end wall 342 and 344 toward a water drain port hole 346 which is positioned asymetrically above the downwardly flared embossment 74. By means of this arrangement the drainage flow path of the water in channels 168 and 169 overflows the weirs and drains down to the evaporation pad and soaks the pad 56 such that the conditioned warm air forced through the pad by the fan is thereby substantially saturated with water vapor. The water droplets that collect by gravity in the drain pan 54 flow into drainage channel 340 and flow on the transverse opposed sloped base surfaces thereof to exit hole 346, for free fall into the sump or embossment 74 and passage via drainage tube 76 for return to the reservoir.

While the embodiment of the present invention as herein disclosed constitutes a preferred form, it is to be understood that other forms might be adopted.

We claim:

1. A humidifier attachment for use with a room air conditioner provided with a casing having means defining an air inlet and a conditioned air outlet on the room side thereof, fan means for flowing air into said casing through said air inlet and out of said casing through means located across the casing room side having a chamber coextensive with the conditioned air outlet, an elongated evaporation water pad assembly supported in said enclosure chamber, said assembly including an upper water distribution receptacle vertically spaced from a lower drain trough with a water pad being retained therebetween, said receptacle having a base enclosed by side walls and end walls, said base having a slot therein overlying said water pad, said slot bordered by a peripheral dike, said dike and said receptacle walls defining water channel means, conduit means for delivering water from a storage tank into said channel means, said dike being formed with a plurality of modified V-notch weirs each having a radiused notch portion to allow said weirs to achieve a predetermined head in said channel means before discharging water into said slot, whereby water is discharged uniformly from each of the weirs to said water pad, and an electrical control circuit interconnecting humidistat switch means located on said storage tank with said fan means whereby said fan means will cycle with said humidistat switch means.

2. A himidifier attachment for use with a room air conditioner provided with a casing having means defining an air inlet and a conditioned air outlet on the room side thereof, fan means for flowing air nto said casing through said air inlet and out of said casing through said conditioned air outlet, said humidifier attachment including an enclosure located across the casing room side having a chamber coextensive with said discharge vent, an elongated evaporation water pad assembly supported in said enclosure chamber, said assembly including an upper water distribution receptacle vertically spaced from a lower drain trough with a water pad being retained therebetween, said receptacle having a base enclosed by side walls and end walls, said base having a plurality of elongated aligned slots therein overlying said water pad, each said slot bordered by a peripheral dike including paired fore and aft portions parallel to said receptacle side walls, said dikes and said receptacle walls defining a pair of water channels interconnected by cross channels formed between adjacent ones of said slots, conduit means for delivering water from a floor mounted water storage tank into said channels, each said dike being formed with a plurality of modified V-notch weirs, each of the weirs haing a radiused notch portion to allow the weirs to achieve a predetermined head before discharging water into their associated slots, whereby water is discharged uniformly from each of the weirs providing gravity feed of water to said water pad, and an electrical control circuit interconnecting humidistat switch means located on said storage tank with said fan means whereby said fan means will cycle with said humidistat switch means.

3. A humidifier attachment for use with a room air conditioner provided with a casing having means defining an air inlet and a conditioned air outlet on the room side thereof, fan means for flowing air into said casing through said air inlet and out of said casing through said conditioned air outlet, said humidifier attachment including enclosure means having upper and lower chambers coextensive respectively with said air inlet and said air outlet, an elongated evaporation water pad assembly supported in said upper chamber, means for supporting electrical resistance heater means in said lower chamber, said assembly including an upper water distribution receptacle vertically spaced from a lower drain trough with said water pad being retained therebetween, said receptacle having a base enclosed by side walls and end walls, said base having a slot therein overlying said water pad, said slot bordered by a peripheral dike, said dike and said receptacle walls defining water channel means, conduit means for delivering water from a storage tank into said channel means, said dike being formed with a plurality of modified V-notch weirs each having a radiused notch portion to allow said weirs to achieve a predetermined head in said channel means before discharging water into said slot, whereby water is discharged uniformly from each of the weirs to said water pad, and an electrical control circuit interconnecting a heater switch located on said storage tank with said heater means, said control circuit heater switch having a plurality of positions whereby the operator may select the amount of heat imparted to the air entering through said air inlet such that the conditioned air is at the desired temperature when discharged from said conditioned air outlet.

4. In combination, a room air conditioner provided with a casing having means defining an air inlet and a conditioned air outlet on the room side thereof, air cooling means including a fan for flowing air into said casing through said air inlet and out of said casing through said conditioned air outlet, and a humidifier attachment including enclosure means in the form of a generally rectangular frame supported in conforming fashion on said casing room side, said frame having upper and lower chambers coextensive respectively with said air inlet and said air outlet, a grille, means for mounting said grille in an upright position across the room side of said frame, an elongated evaporation water pad assembly supported in said upper chamber means for supporting electrical resistance heater means in said lower chamber, said assembly including an upper water distribution receptacle vertically spaced from a lower drain trough with said water pad being retained therebetween, said receptacle having a base enclosed by side walls and end walls, said base having a plurality of slots therein overlying said water pad, each said slot bordered by a peripheral dike, said dikes and said receptacle walls defining water channel means, conduit means for delivering water from a storage tank into said channel means, said dike being formed with a plurality of modified V-notch weirs each having a radiused notch portion to allow said weirs to achieve a predetermined head in said channel means before discharging water into said slot, whereby water is discharged uniformly from each of the weirs to said water pad, and an electrical control circuit interconnecting a heater switch located on said storage tank with said heater means, said control circuit heater switch having a plurality of positions whereby the operator may select the amount of heat imparted to the air entering through said air inlet such that the conditioned air is at the desired temperature when discharged from said conditioned air outlet, humidistat switch means located on said storage tank, and said control circuit interconnecting said humidistat switch means with said fan whereby said fan will cycle with said humidistat switch means.

* * * * *